US005156464A

United States Patent [19]

Sakai

[11] Patent Number: 5,156,464

[45] Date of Patent: Oct. 20, 1992

[54] PRINTER HAVING GAP ADJUSTING APPARATUS FOR PRINT HEAD

[75] Inventor: Kiyoharu Sakai, Suzuka, Japan

[73] Assignee: Brother Kogyo Kabushiki Kaisha, Nagoya, Japan

[21] Appl. No.: 849,972

[22] Filed: Mar. 12, 1992

[30] Foreign Application Priority Data

May 31, 1991 [JP] Japan ..... 3-157680

[51] Int. Cl.[5] ..... B41J 11/20

[52] U.S. Cl. ..... 400/56; 400/55; 400/59

[58] Field of Search ..... 400/55-59, 400/120

[56] References Cited

U.S. PATENT DOCUMENTS

| | | | |
|---|---|---|---|
| 4,676,675 | 6/1987 | Suzuki | 400/59 |
| 4,865,475 | 9/1989 | Takahashi | 400/144.2 |
| 4,881,835 | 11/1989 | Niikawa | 400/56 |
| 4,974,974 | 12/1990 | Yoshida et al. | 400/59 |
| 4,990,004 | 2/1991 | Kawahara et al. | 400/56 |
| 5,074,685 | 12/1991 | Shimizu et al. | 400/56 |
| 5,088,842 | 2/1992 | Ito et al. | 400/59 |
| 5,088,843 | 2/1992 | Hori | 400/59 |

FOREIGN PATENT DOCUMENTS

| | | | |
|---|---|---|---|
| 71668 | 4/1987 | Japan | 400/55 |
| 303760 | 12/1988 | Japan | 400/56 |
| 45353 | 2/1991 | Japan | 400/56 |
| 58875 | 3/1991 | Japan | 400/56 |

*Primary Examiner*—Clifford D. Crowder
*Assistant Examiner*—Joseph R. Keating
*Attorney, Agent, or Firm*—Oliff & Berridge

[57] ABSTRACT

The invention provides an apparatus capable of manually adjusting a gap between a print head and a platen so as to prevent a print operation from being executed when the gap is outside of an appropriate range for a paper being used. The position of the print head can be manually adjusted by use of an adjusting lever. Further, the print head can be moved by a step motor under the control of a CPU to adjust the gap. After the gap adjustment is accomplished by the adjusting lever, the CPU causes the print head to shift toward a rear standard position and stores the count N1 of driving pulses required for the shift movement. The set printing gap is detected on the basis of this value N1. The print head is then moved until it contacts the printing sheet and a count N2 of driving pulses required for the contact movement is stored in the memory of the CPU. The paper thickness is measured on the basis of this value N2. Based on the paper thickness, an adequate gap range is read out from the ROM and, if the set printing gap is outside of this range, a warning is given.

15 Claims, 7 Drawing Sheets

Fig.6B

| ITEM | INSTRUCTIONS |
|---|---|
| S1 | AUTOMATIC PAPER THICKNESS ADJUSTMENT ? |
| S2 | AUTOMATIC ADJUSTMENT TO ADEQUATE GAP CORRESPONDING TO PAPER THICKNESS |
| S3 | PRINTING OPERATION |
| S4 | RETREAT PRINT HEAD |
| S5 | STANDARD POSITION ? |
| S6 | STORE DRIVING PULSE COUNT N1 |
| S7 | SHIFT CARRIAGE |
| S8 | DETECT HOME POSITION ? |
| S9 | PRINTING SHEET KIND DETECTION |
| S10 | PAPER END DETECTED ? |
| S11 | DISCHARGE SINGLE SHEET |
| S12 | PAPER END DETECTED ? |
| S13 | FEED PRINTING SHEET |
| S14 | ADVANCE PRINT HEAD |
| S15 | STOPPAGE OF PRINT HEAD DETECTED ? |
| S16 | STORE DRIVING PULSE COUNT N2 |
| S17 | SHIFT PRINT HEAD FROM STANDARD POSITION BY PULSE N1 |
| S18 | DETERMINE THICKNESS OF PRINTING SHEET $t_p = L-(\ell \times N2 + t_m + t_r)$ |
| S19 | DETERMINE ADJUSTED GAP $G = L - \ell \times N1$ |
| S20 | ADEQUATE GAP ? |
| S21 | PRINTING OPERATION |
| S22 | INPUT INADEQUATE GAP SIGNAL INTO INTERFACE |
| S23 | TURN ON LCD AND CHECK LAMP ON DISPLAY PANEL |
| S24 | ENFORCE? |
| S25 | OFF LINE MODE CHANGED INTO ON LINE MODE? |
| S26 | PRINTING OPERATION |

PRINTER HAVING GAP ADJUSTING APPARATUS FOR PRINT HEAD

BACKGROUND OF THE INVENTION

1. Field of the Invention

The invention relates to a gap adjusting apparatus capable of judging whether a gap between a platen and a print head is set suitably for the thickness of a printing sheet.

2. Description of Related Art

Conventionally, in this kind of apparatus, when required to change a printing density of a character to be printed on the printing sheet, the gap between the platen and the print head is adjusted manually based on the operator's experience.

Further, when printing sheets having different thicknesses are printed in parallel, for example, in the case of a printing sheet that has a label portion thereon and, therefore, the label portion and the printing sheet portion have different thicknesses, the gap is determined by the experienced manual operation on the basis of an intermediate thickness between both paper thicknesses.

However, when the gap between the platen and the print head is adjusted by the experienced manual operation as described above, the gap is not always within an adequate range and is outside of the adequate range in many cases. In such cases, if the printing operation is executed when the gap is not adequately adjusted, it results in not only remarkable deterioration of the print head but also an increase in running costs due to frequent exchanges of the print heads. Also, the degraded quality of the printed characters sometimes forces a reprint from the beginning of the material.

Especially, in the case of a print head, that is a wire dot head which performs its printing operation through a print ribbon, there arise problems such as a jam due to damage to a print wire or the print ribbon.

Moreover, although an apparatus capable of performing automatic adjustment is disclosed in U.S. Pat. No. 4,990,004, it still requires manual adjustment for a label sheet and the like. In this case, if the operator forgets to make a mode change between automatic adjustment and manual adjustment, the printing operation is carried out with the gap not corrected.

SUMMARY OF THE INVENTION

An object of the invention is to provide a gap adjustment apparatus for a print head, capable of judging whether or not the gap between a platen and a print head is within an adequate range in consideration of a thickness of the printing sheet in order to maintain good print quality as well as to prevent deterioration of the print head.

In order to accomplish the above object, the invention provides a gap adjusting apparatus for a print head that adjusts a gap between a platen and a print head facing the platen, comprising: gap setting means which is operative to cause advance or retreat movement of the print head with respect to the platen by manual operation to adjust the gap; gap detecting means for detecting the gap; paper thickness detecting means for detecting paper thickness of the printing sheet; and signal generating means which judges whether or not a gap adjusted by the gap setting means is within an adequate range set on the basis of the paper thickness detected by the paper thickness detecting means and generates a signal when the gap adjusted by the gap setting means is not within the adequate range.

In a gap adjusting apparatus for a print head according to the invention structured as described above, the gap adjusted by the gap setting means is detected and the paper thickness of the printing sheet installed on the platen is detected by the paper thickness detecting means. Then, it is judged whether or not the adjusted gap, based upon the detected paper thickness of the printing paper, is within the adequate range. The signal generating means generates a signal when the gap adjusted by the gap setting means is not within the adequate range.

According to the invention, as apparent from the foregoing description, it is possible to detect whether the gap set between the platen and the print head is within an adequate range by taking the paper thickness of the printing sheet into consideration, thereby providing a gap adjusting apparatus for a print head which is capable of not only maintaining good printing quality but also preventing deterioration of the print head. Accordingly, the effects of the invention greatly benefit users.

BRIEF DESCRIPTION OF THE DRAWINGS

The invention will be described with reference to the figures in which:

FIG. 6B is a table of labels for the flowchart of FIG. 6A; and

DETAILED DESCRIPTION OF THE PREFERRED EMBODIMENT

Figure 1:
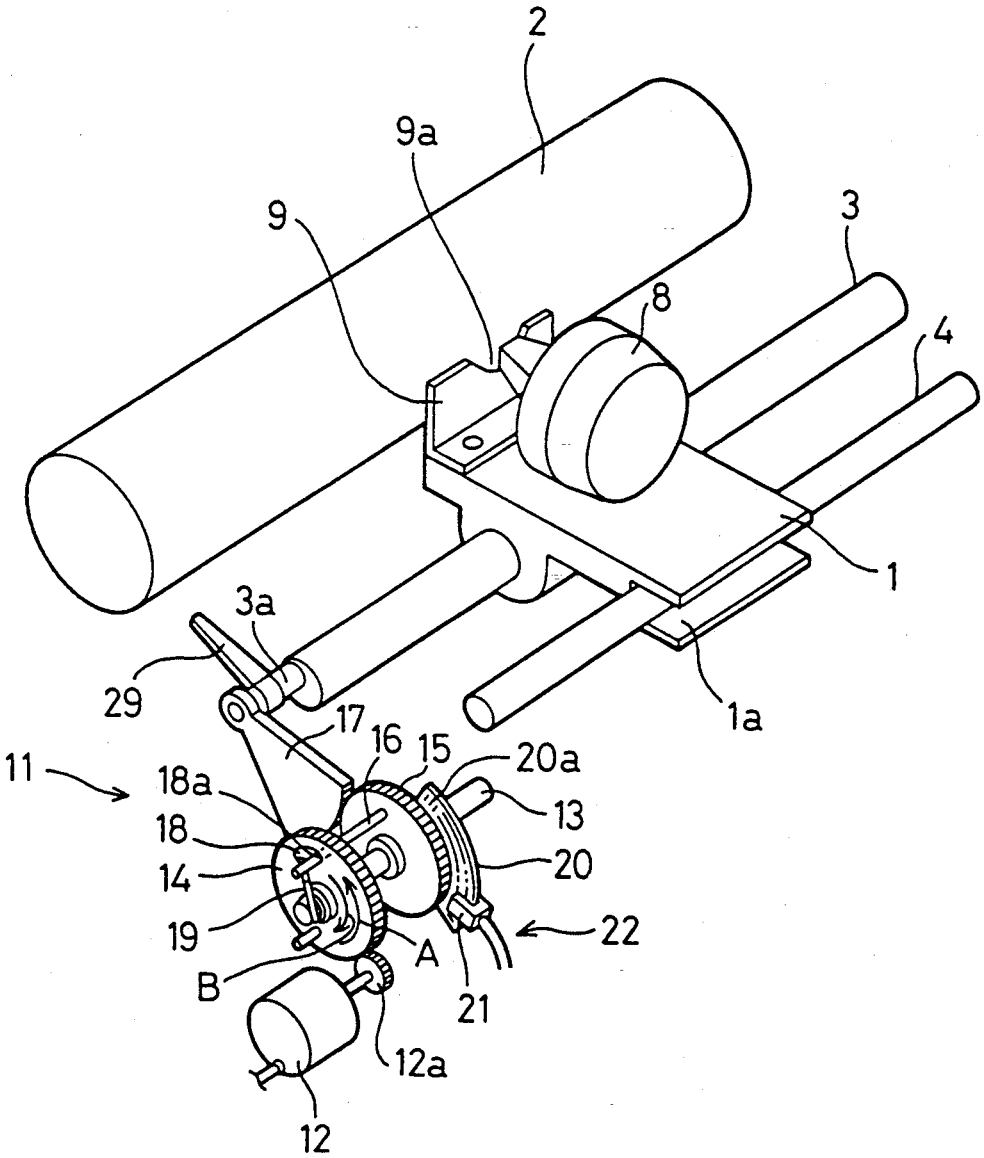
FIG. 1 is a schematic portrayal of a print mechanism for a dot printer.

FIG. 1 shows the structure of the essential parts of the dot printer. Carriage 1 is slidably installed on a guide bar 3 which is disposed in parallel with a platen 2. A slide groove 1*a* is provided on a first side of the carriage 1. A fixed bar 4 is loosely coupled in the slide groove 1*a* and extends parallel to guide bar 3. The carriage 1 is operative to slide reciprocally along the guide bar 3 by means of a well-known carriage driving mechanism comprising a pair of pulleys (not shown), a belt (not shown), and a driving motor 5 (refer to FIG. 5).

Figure 2:
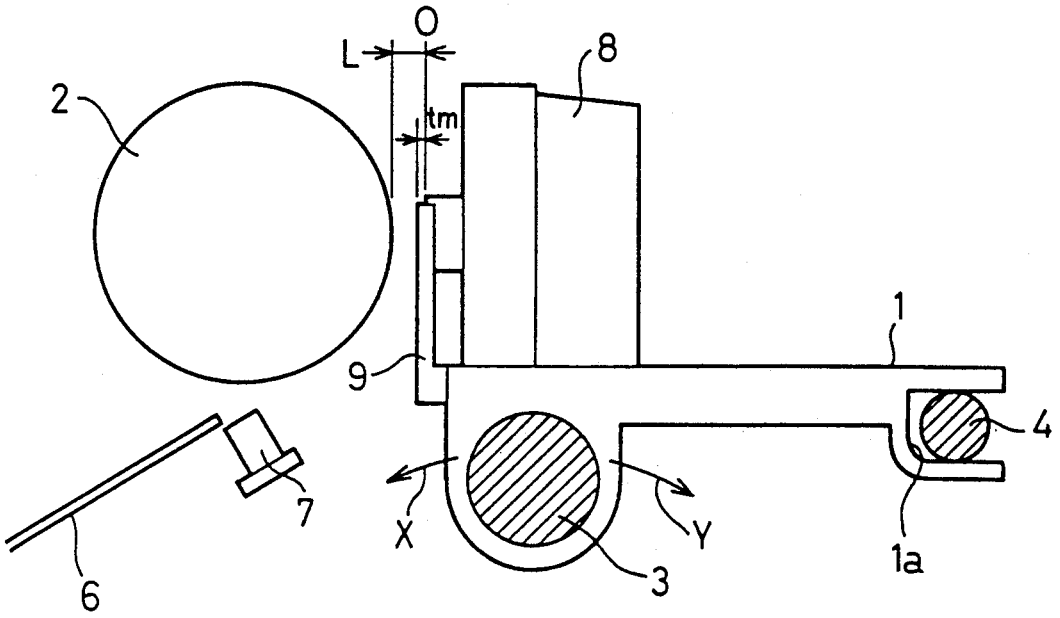
FIG. 2 is a side view showing a distance between a print head, positioned in a standard position, and a platen.
Figure 3:
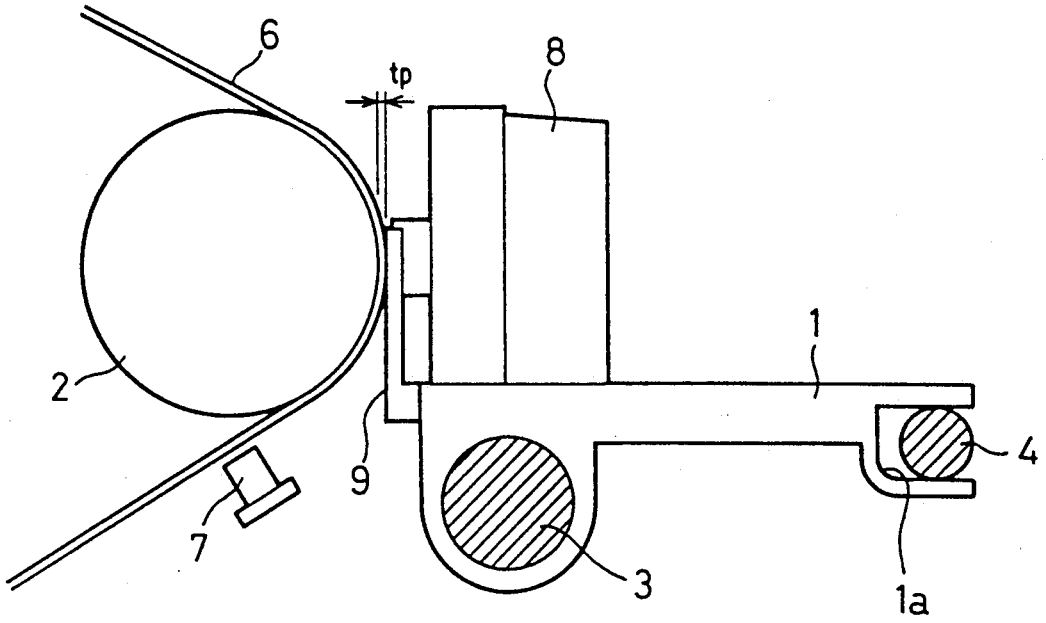
FIG. 3 is a side view showing a thickness of a printing sheet installed on the platen.
Figure 4:
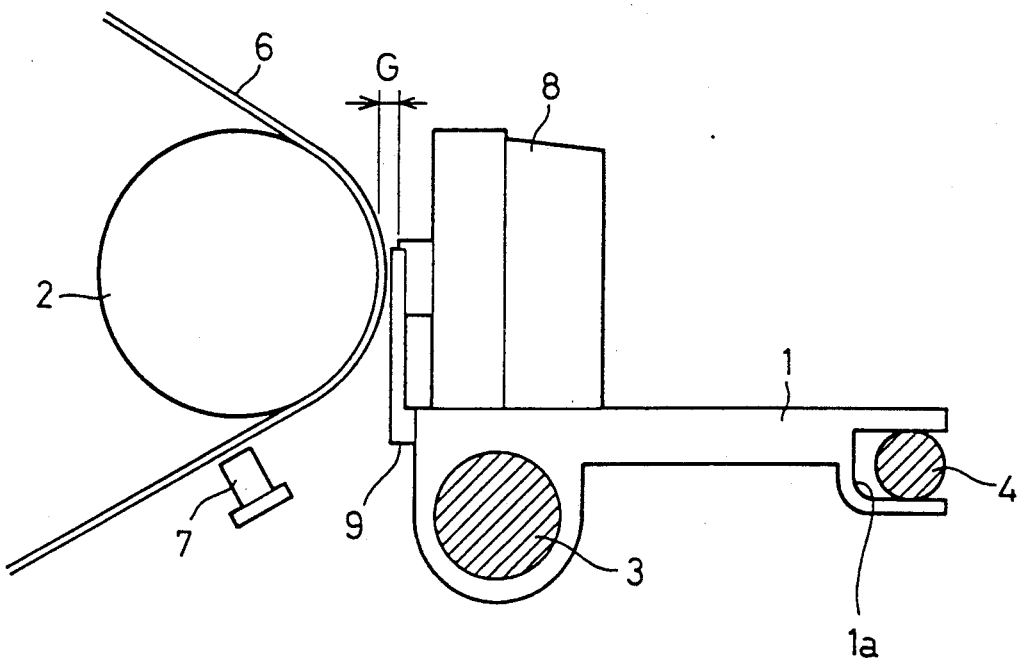
FIG. 4 is a side view showing a gap set between the print head and the platen.

Further, both ends of the platen 2, the guide bar 3 and the fixed bar 4 are supported on side plates (not shown) which are provided in a main body of the printer. Near the platen 2 there is provided a paper detecting sensor 7 for detecting whether a printing sheet 6 is installed on the platen 2 (FIGS. 2 through 4).

Mounted on the carriage 1 is a dot impact type print head 8 and an exchangeable ink ribbon cassette (not shown). Further, in front of the print head 8 there is provided a ribbon mask 9 for preventing the print sheet 6 from being stained by contact with the ink ribbon.

The print head 8 is equipped with a plurality of print wires at the front portion thereof. These print wires are protruded toward the platen 2 so that the ink ribbon is pressed forward beyond a cutout portion 9*a* of the ribbon mask 9. With this arrangement, while moving in the widthwise direction of the printing sheet 6 installed on the platen 2 in accordance with the movement of the carriage 1, the print head 8 performs a printing operation by striking the ink ribbon onto the surface of the printing sheet to leave an ink image.

In this instance, the printing sheet 6 is fed by a sheet feeding mechanism 10 (refer to FIG. 5) which drives the platen 2 to rotate.

Figure 5:
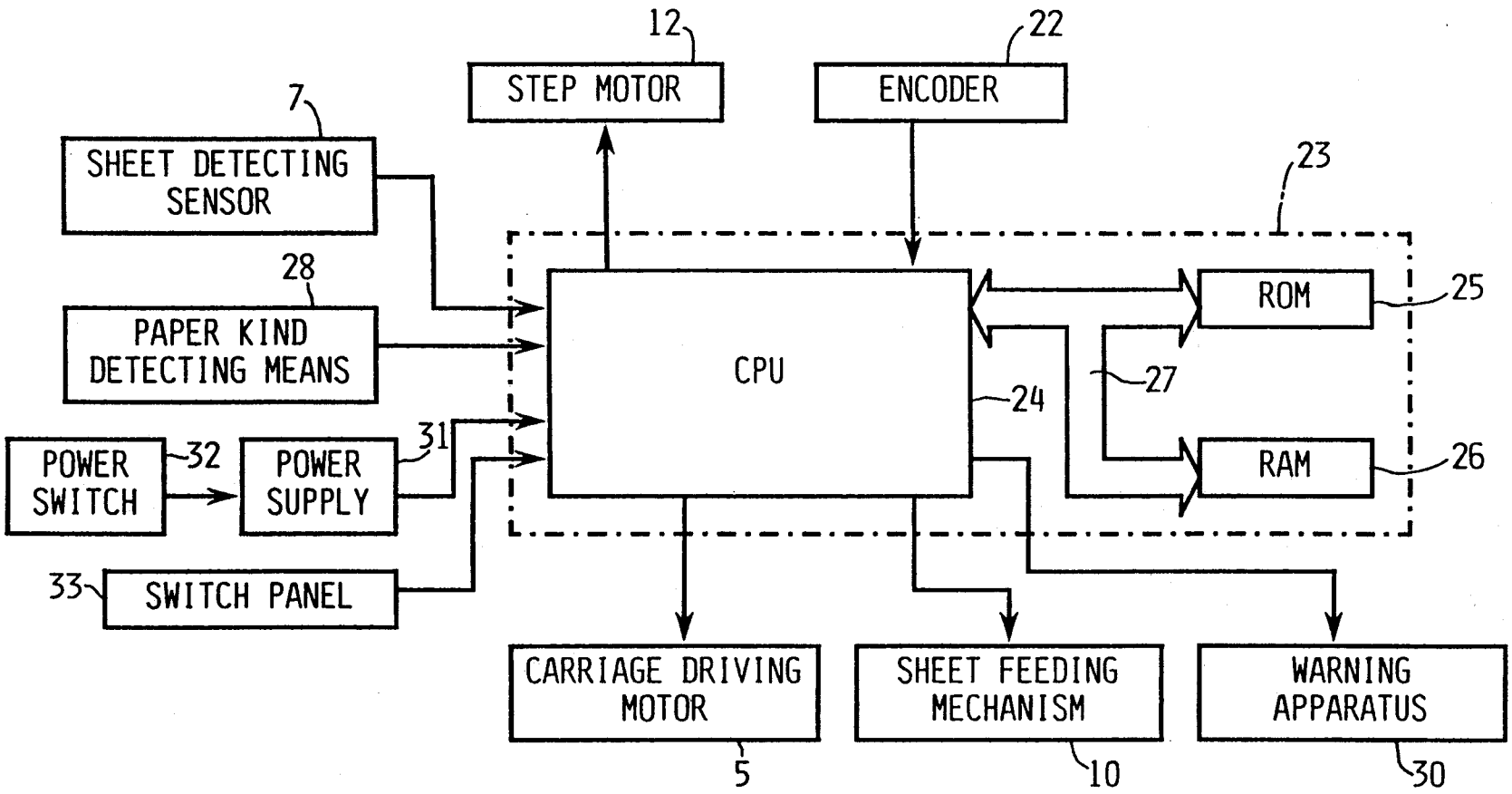
FIG. 5 is a block diagram showing the control portion of a gap adjusting apparatus.

On an external operation panel (not shown) of the printer, there is provided a warning apparatus 30 (FIG. 5). The warning apparatus 30 is adapted to give a warning to the operator to indicate the gap inadequacy in the case where the gap between the platen 2 and the fore end of print head 8 is outside of an adequate range (FIG. 4). The warning apparatus 30 may be of any type, such as an LCD, a checking lamp or a buzzer so long as it draws the operator's attention.

In order to carry out a suitable print operation with the print head 8 constructed as described above, it is necessary to maintain a gap G of a proper distance between the platen 2 and the fore end of the print head 8 according to the thickness of the printing sheet 6.

The following is an explanation of a mechanism for adjusting the gap G required for suitable print operations.

In FIG. 1, each end of the guide bar 3 is integrally provided with an eccentric shaft portion 3*a* (only one is shown in the drawing) at a position that deviates from the axis of the guide bar 3. The eccentric shaft portion 3*a* is rotatably supported on the side plate (not shown) and, therefore, the guide bar 3 is rotatable about the eccentric shaft, that deviates from the center of the guide bar 3, in the directions indicated by arrows X and Y (FIG. 2).

Further, a gap adjusting lever 29 is fixed to the eccentric shaft portion 3*a*, at one end of guide bar 3, so that the operator can adjust the gap G between the platen 2 and the print head 8 using the gap adjusting lever 29. The adjusting lever 29 is located so as to be hidden by the upper cover of the printer when the cover is closed. With this arrangement, the guide bar 3 is rotated about the eccentric shaft 3*a* by moving the adjusting lever 29 in the direction of the arrows X or Y, whereby the print head 8, installed on the carriage 1, is moved to either advance toward (X) or retreat from (Y) the platen 2.

The eccentric shaft portion 3*a* is also connected to a contact/release mechanism 11. The guide bar 3 can also be rotated in the direction of the arrows X or Y by the contact/release mechanism 11. In the contact/release mechanism 11, a rotational force of a step motor 12 is transmitted at a reduced speed through a gear 12*a* to a driving gear 14 rotatably provided on a shaft 13. The rotational force of the driving gear 14 is transmitted to a driven gear 15 rotatably provided on the shaft 13 through the action of a pin 16. The rotational force of the driven gear 15 is then transmitted to a swing gear 17 fixed to an end portion of the eccentric shaft portion 3*a*.

The pin 16 has one end fixed to the driven gear 15 and the other end is inserted through an elongated curvilinear hole 18 formed on the driving gear 14 and paralleling the outer circumference of the driving gear 14. At the same time, the pin 16 is biased toward one end portion 18*a* of the elongated hole 18 by the force exerted by a twist coil spring 19 which is provided on the driving gear 14.

Consequently, the rotation of the driving gear 14 in the direction of the arrow A caused by the forward rotation of the step motor 12 is directly transmitted to the driven gear 15 and, therefore, the guide bar 3 is rotated toward the direction indicated by the arrow Y or rearwardly. Accordingly, the print head 8 retreats to be further separated from the platen 2.

In a similar manner, the rotation of the driving gear 14 in the direction indicated by an arrow B, caused by the reverse rotation of the step motor 12, is transmitted to the driven gear 15 through the twist coil spring 19 so as to rotate the guide bar 3 in the direction indicated by the arrow X. Thus, the print head 8 is advanced to approach the platen 2.

In this case, the advance movement of the print head 8 is restricted when the ribbon mask 9 provided at the fore end of the print head 8 contacts the printing sheet 6 installed on the platen 2. If the load torque of the driven gear 15 is increased beyond a predetermined value due to this restriction, the twist coil spring 19 is deformed. Therefore, the rotational force is no longer transmitted to the pin 16 and the driven gear 15 is stopped.

In other words, a pressing force generated when the ribbon mask 9 provided on the front end of the print head 8 is pressed on the platen 2 or the printing sheet 6 becomes a pressure corresponding to the spring force of the twist coil spring 19.

There is also, in the contact/release mechanism 11, an encoder 22 comprising a turning disk 20 mounted on the driven gear 15 and having a plurality of slits 20*a*, and a photo-interrupter 21 for detecting penetration or blockage of the light by the turning disk 20. The encoder 22 serves to detect that the driven gear 15 is stopped when the ribbon mask 9 is pressed to the platen 2 or the printing sheet 6 and to control stopping of the print head 8 at a predetermined position (hereinafter, referred to as "a standard position O") sufficiently far from the platen 2. An output generated from the encoder 22 is supplied to a control apparatus 23, which is described in detail later.

A current to hold the rotational position of the step motor 12 is applied to the step motor 12 when the step motor 12 is stopped. If the adjusting lever 29 is rotated against the holding force of the step motor 12, the driving gear 14 is cooperatively rotated by an urging force of the coil spring 19 and the pin 16 is maintained in contact with the end of the elongated hole 18.

As shown in FIG. 5, the control apparatus 23 comprises a CPU (central processing unit) 24, a ROM (read only memory) 25 for storing later-described programs, a RAM (random access memory) 26 for temporarily storing data, and a bus 27 for mutually connecting the CPU, ROM and RAM.

The ROM 25 has stored permanently therein data relating to the gap G that is optimum for performing a print operation according to the thickness of the printing sheet 6 (i.e., experimentally obtained data defining the appropriate gap corresponding to the thickness of the printing sheet 6). In this embodiment, the optimum gap G can be varied in accordance with the thickness tp (FIG. 3) so that the gap G in the case of a large thickness tp of the printing sheet 6 is smaller than the gap G in the case of a small thickness tp of the printing sheet 6. The smaller gap G increases an impact force of the print head 8 on the thicker sheet 6.

Moreover, the control apparatus 23 is connected to the encoder 22 and the step motor 12. The control apparatus 23 controls the activation and deactivation of the step motor 12 in response to an output from the encoder 22 and an output from the sheet detecting sensor 7. The control apparatus 23 counts the driving pulses required, from the activation of the step motor 12 at the standard position O until the stoppage of the step motor 12, when the ribbon mask 9 contacts the sheet 6 to detect the shift distance of the print head 8 from the standard position O as a pulse count of the step motor 12.

The control apparatus 23 is also connected to a paper kind detecting means 28, such as a limit switch, for detecting whether the printing sheet is a single sheet or a consecutive sheet. An output from the paper kind detecting means 28 is input into the control apparatus 23.

Further, the control apparatus 23 is connected to the warning apparatus 30. The warning apparatus 30 is activated to give a warning to the operator when it is judged that the gap G set by the gap adjusting lever 29 is not within an adequate range.

Moreover, the control apparatus 23 is connected to a power supply 31. The power supply 31 is connected to a power switch 32. A switch panel 33 is also connected to the control apparatus 23. The switch panel 33 includes a select switch for changing over between an on-line mode and an off-line mode, a paper feed switch for generating a paper feed command, a gap mode switch for changing over between an automatic gap adjusting mode and a manual gap adjusting mode, and override switch for generating a forcible operation command.

The control apparatus 23 also controls the motor 5 for the carriage driving mechanism, the sheet feeding mechanism 10 and the like.

Figure 6A:
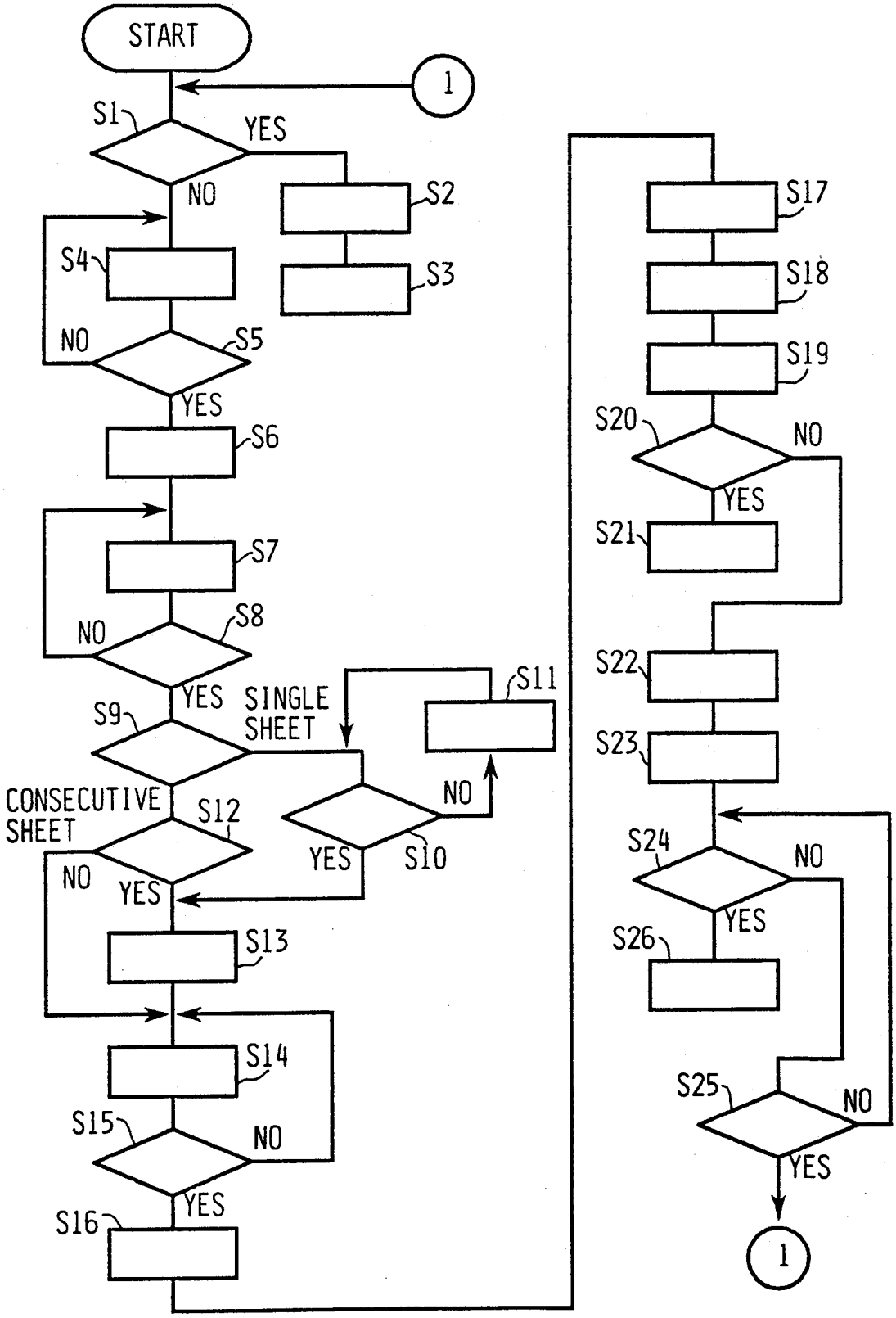
FIG. 6A is a flowchart of a control processing for the gap adjusting apparatus.

FIGS. 6A and 6B are a flow chart, with labels, showing the control processing of the control apparatus of the embodiment according to the present invention. When the power switch 32 is turned on, when the on-line mode is selected by the select switch after the print cover is closed or when the paper feed command is generated by the paper feed switch, a confirming operation is carried out to determine whether the gap G between the print head 8 and the platen 2, which is set by the gap adjusting lever 29, is within the optimum range stored in the ROM 25 on the basis of the program stored in the ROM 25.

First, in step (hereinafter referred to simply as "S") 1, it is judged, based on the state of the gap mode switch, whether the operation mode is the automatic gap adjusting mode, wherein the printer automatically adjusts the gap G between the print head 8 and the platen 2 in accordance with the thickness tp of the printing sheet 6, or the manual gap adjusting mode wherein the operator manually adjusts the gap G.

If the answer in S1 is "Yes", that is, the printer is in an automatic gap adjusting mode, the processing proceeds to S2 and reads out a value of the range adequate for the gap G according to the thickness tp of the printing sheet 6. The print head 8 is shifted in accordance with the read-out gap G, and subsequently, the printing operation is performed in S3. Since this processing is the same as the processing described in U.S. Pat. No. 4,990,004, U.S. Pat. No. 4,990,204 being incorporated herein by reference, its detailed explanation is omitted.

If the answer in S2 is "No", the control processing proceeds to S4. The judgement whether the gap G, set by the operator using the gap adjusting lever 29, is within the adequate gap data range stored in the ROM 25 is carried out according to the following procedure. In. S4, the print head 8 is retreated from the platen 2 by means of the contact/release mechanism 11 (the direction indicated by the arrow Y in FIGS. 2 and 7) and is stopped at the standard position O.

Stopping of the step motor 12 is controlled on the basis of the output from the encoder 22. That is, during the shift of the print head 8, the wave form of the signal from the encoder 22 varies alternatively between a high level and a low level within a short time interval. However, when the carriage 1 reaches the standard position O, the wave form of the signal stops varying and remains at a low level (or a high level) during a predetermined period of time. By detecting this, the activation of the step motor 12 is stopped.

The step motor 12 operation is continued until the standard position O is detected (S5). When it is detected that the print head 8 has reached the standard position O, the pulse count N1, the number of electrical pulses from activation until the step motor 12 stops is stored in the RAM 26 in S6. Next, the carriage 1 is shifted along guide bar 3 to the home position, which is located adjacent to the starting position for the printing, by means of the motor 5 of the carriage driving mechanism (S7, S8).

In S9, based on the detection of the sheet kind detecting means 28, it is judged whether the printing sheet 6 is a single sheet or a consecutive sheet. In this instance, when the printing sheet is the single sheet, it is judged in S10, by the paper detecting sensor 7, whether the printing sheet is installed on the platen 2, i.e., whether the end portion of the paper is detected. If a printing sheet 6 is installed on the platen 2, the printing sheet 6 is discharged by the sheet feeding mechanism 10 (S11) and, subsequently, a next printing sheet 6 is fed so as to be installed on the platen 2 (S13). The control processing then proceeds to S14.

On the other hand, if the answer in S9 is a consecutive sheet has been detected, the control processing proceeds to S12. If it is judged that the printing sheet 6 is not installed on the platen 2, i.e., YES, in S13 the printing sheet 6 is fed onto the platen 2 in a way similar to that of the single sheet. Then, the control processing proceeds to S14. If it is judged that the printing sheet 6 is installed on the platen 2 (i.e., NO), the control processing proceeds directly to S14.

Figure 7:
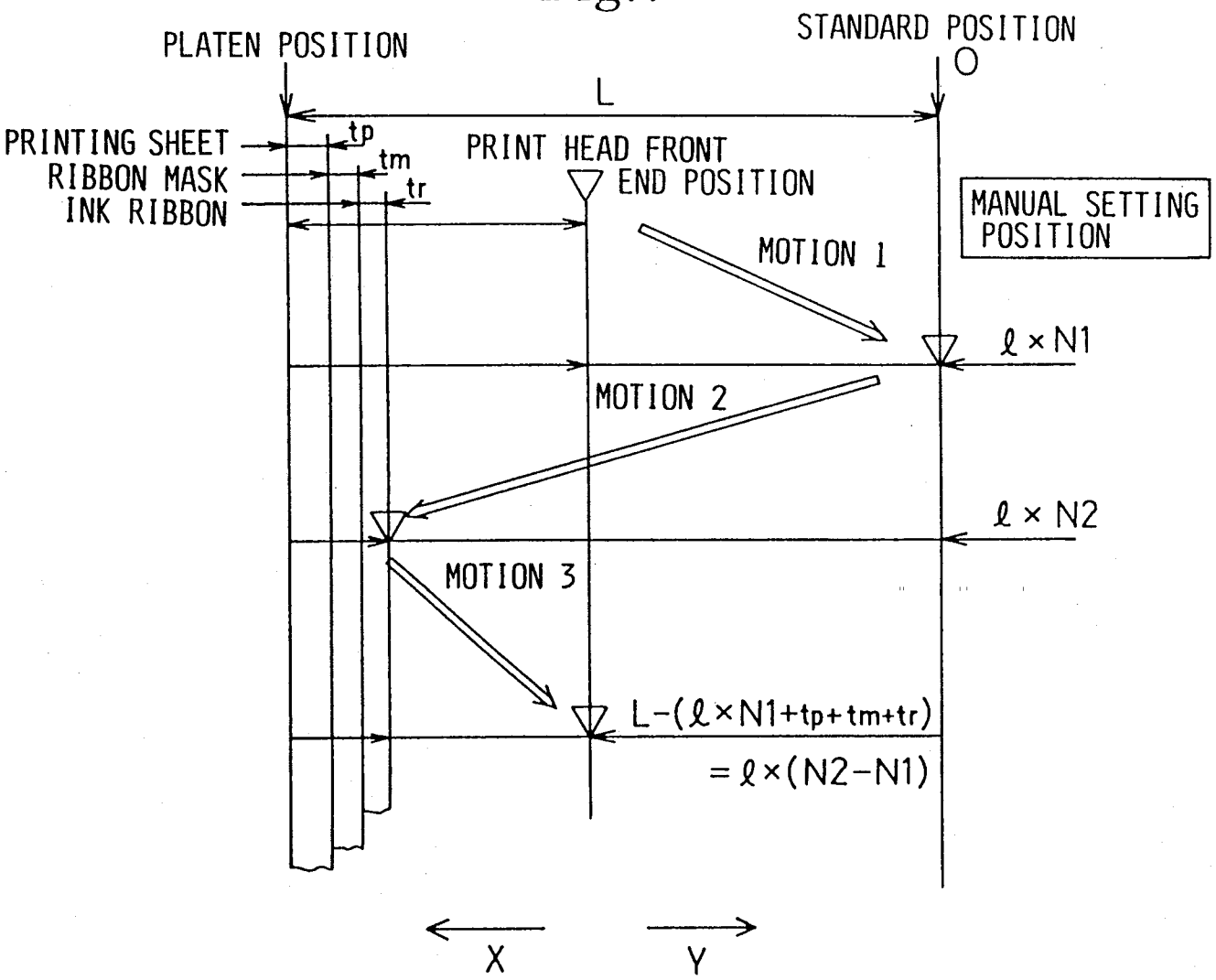
FIG. 7 is a portrayal of a gap confirming operation of the print head.

Next, in S14 through S16, the print head 8, starting in the standard position O, is advanced toward the platen 2 by means of the contact/release mechanism 11 until stoppage of the print head 8 is detected. The position of the print head 8 at the time the ribbon mask 9, provided at the front end of the print head 8, is pressed against the printing sheet 6 on the platen 2 is detected and stored in the RAM 26. That is, if the driving pulses are supplied to the step motor 12, the print head 8, positioned in the standard position O, advances in the direction X (FIGS. 2 and 7). As a result of this advancing movement, the ribbon mask 9 contacts the printing sheet 6 on the platen 2.

In this case, the ribbon mask 9, provided at the front end of the print head 8, is pressed by the pressing spring force of the twist coil spring 19. At this time, the encoder 22 detects the stoppage of the turning disk 20 together with the stoppage of the driven gear 15 and the step motor 12 is deactivated. Further, the driving pulse count N2 of the number of pulses applied to the step motor 12 until it stops is stored in the RAM 26 as a shift distance from the standard position O.

In S17, the step motor 12 is activated again, the print head 8 is retreated to the original position set by the gap adjusting lever 29, that is, retreated by the actuation of (N2−N1) electrical pulses.

Next, in S18, the paper thickness tp of the printing sheet 6 is calculated on the basis of the driving pulse count N2 obtained as described above using the following conditions:

(1) the shift distance of the print head 8 per one pulse of the step motor 12 is defined to approximate to l;

(2) the distance from the standard position O to the platen 2 is defined to be L;

(3) the thickness of the ribbon mask is determined to be tm;

(4) the thickness of the ink ribbon is determined to be tr; and (5) the paper thickness of the printing sheet 6 is defined to be tp.

Taking above conditions into consideration, the paper thickness tp of the printing sheet 6 is obtained according to the following equation.

$$tp = L - (l \times N2 + tm + tr)$$

Further, in S19, based on the driving pulse count N1 obtained in S6, the gap G set by the gap adjusting lever 29 is calculated according to the following equation:

$$G = L - l \times N1.$$

Subsequently, in S20, an adequate range of the gap is read out from the ROM 25 that corresponds to the paper thickness tp of the printing sheet 6 calculated in S18. It is then judged whether or not the gap G obtained in S19 is within the adequate range. If the answer in S20 is "Yes", the print operation is started in S21.

On the other hand, if the answer in S20 is "No", the gap G set by the gap adjusting lever 29 is not within the adequate range with respect to the printing sheet 6. This condition is input to the external devices, such as a host computer, as an interface signal in S22 and the control processing indicates this condition to the operator by turning on the warning apparatus 30, the LCD, the check lamp or buzzer, in S23. By doing this, it is impossible to initiate the printing operation unless a forcible operation is commanded by activating the override switch of the switch panel 33 in S24. Thus, printing operations are positively prevented from being carried out in the condition where the gap is not properly adjusted with respect to the paper thickness tp of the printing sheet 6.

When the warning apparatus 30 is turned on, and after the on-line mode is changed to the off-line mode by using select switch, the operator opens the upper cover and adjusts the adjusting lever 29 as necessary. After this, when the upper cover is closed, and the off mode is changed back to the on-line mode (S25), the above-described operation is again repeated. However, in this case, the processing of S11 is skipped. Moreover, the steps for measuring N2 can be omitted.

As explained in the foregoing description, in the gap adjusting apparatus in the embodiment according to the invention, the print head 8 performs a printing operation with a gap appropriate to the paper thickness tp of the printing sheet 6, and therefore, it is possible to carry out the printing operation without deterioration of the printed characters to produce high quality print. Moreover, by preventing the printing operation under the condition where the gap is not appropriate to the thickness tp of the printing sheet 6, not only are print stains or damage to the ink ribbon caused by a short gap clearance prevented but damage to the wire supporting spring or wear of the wire guide due to an increased slide friction caused by a large gap clearance are also prevented. As a result, the life cycle of the print head 8 can be greatly extended.

Moreover, although in the embodiment according to the invention, using the paper thickness tp of the printing sheet 6, the value of the adequate gap range is read out from the ROM 25, it is also possible for the control apparatus 23 to calculate the gap range in accordance with the following equations.

$$(tp \leqq 0.2\ \text{mm}):\ tp + 0.28\ \text{mm} \sim tp + 0.32\ \text{mm}$$

$$(tp > 0.2\ \text{mm}):\ tp + 0.23\ \text{mm} \sim tp + 0.28\ \text{mm}$$

Further, in the present embodiment according to the invention, although N1 and N2 are defined as the driving pulse counts of the step motor 12, they are measured more accurately if they are defined as the count generated from the encoder 22.

Still further, the present invention can be applicable to an apparatus using a non-rotary type flat platen or an apparatus using a piezoelectric type print head.

Especially, in the case where the print head using a piezoelectric element is adopted, during a printing operation, the pressure applied to the piezoelectric element caused by the spring-back of the printing wire against the printing sheet is checked by monitoring an electromotive force generated in the piezoelectric element. If the printing gap is calculated by considering a time required after the printing operation is initiated until the electromotive force is generated, the printing gap can be calculated by using a real time with respect to the labelled sheet having an uneven surface and the warning can be generated on demand. Further, it may also be possible to interrupt the printing operation while the warning is given.

What is claimed is:

1. A print head gap adjusting apparatus for a printer capable of adjusting a gap between a platen and a print head, comprising:

gap setting means for causing the print head to advance/retreat from said platen;

gap detecting means for determining the size of the gap set by said gap setting means;

paper thickness detecting means for detecting the thickness of a printing sheet;

comparison means including means to determine an appropriate gap range and means for comparing the gap size to the gap range appropriate to the thickness of the printing sheet detected by said paper thickness detecting means; and signal generating means for generating a signal when the gap size is outside the gap range based on a result of the comparison by said comparison means.

2. The print head gap adjusting apparatus as claimed in claim 1, further comprising a paper end detecting means for detecting a presence of the printing sheet.

3. The print head gap adjusting apparatus as claimed in claim 1, wherein said gap setting means comprises:

an eccentrically rotatable guide bar mounting said print head; and a lever fixedly attached to one end of said guide bar.

4. The print head gap adjusting apparatus as claimed in claim 3, wherein said gap detecting means comprises:

a stepping motor;

a swing gear fixedly mounted to said guide bar;

a gear train between said stepping motor and said swing gear;

a counter selected from a group consisting of a motor step counter of said stepping motor and an encoder mounted to one gear of said gear train; and a gap calculation means for calculating an actual gap based on an output from said counter in moving from am adjusted position to a predetermined home position and a predetermined distance between said print head at the home position and said platen.

5. The print head gap adjusting apparatus as claimed in claim 3, wherein said paper thickness detecting means comprises:

a stepping motor;

a swing gear fixedly mounted to said guide bar;

a gear train between said stepping motor and said swing gear;

a counter selected from a group consisting of a motor step counter of said stepping motor and an encoder mounted to one gear of said gear train; and a thickness calculation means for calculating a printing sheet thickness based on an output from said counter when advancement of said print head has been stopped against the printing sheet and a predetermined distance between said print head at a predetermined home position and said platen.

6. The print head gap adjusting apparatus as claimed in claim 1, wherein the gap range is one of a predetermined gap range correlated to the thickness of the printing sheet and a range that is calculated based upon predetermined factors and the thickness of the printing sheet.

7. The print head gap adjusting apparatus as claimed in claim 1, further comprising prohibiting means for prohibiting a printing operation when said signal generating means signals the gap size is outside the gap range.

8. A printer, comprising:

a printer body;

a platen supported in said printer body;

a print head mounted for reciprocal movement in said printer body, said reciprocal movement parallel to a longitudinal axis of said platen; and a print head gap adjusting apparatus comprising:

gap setting means for causing the print head to advance/retreat from said platen;

gap detecting means for determining the size of the gap set by said gap setting means;

paper thickness detecting means for detecting the thickness of a printing sheet;

comparison means including means to determine an appropriate gap range and means for comparing the gap size to the gap range appropriate to the thickness of the printing sheet detected by said paper thickness detecting means; and signal generating means for generating a signal the gap size is outside the gap range based on a result of a comparison by said comparison means.

9. The printer as claim in claim 8, further comprising a paper end detecting means for detecting a presence of the printing sheet.

10. The printer as claimed in claim 8, wherein said gap setting means comprises:

an eccentrically rotatable guide bar mounting said print head; and a lever fixedly attached to one end of said guide bar.

11. The printer as claimed in claim 10, wherein said gap detecting means comprises:

a stepping motor;

a swing gear fixedly mounted to said guide bar;

a gear train between said stepping motor and said swing gear;

a counter selected from a group consisting of a motor step counter of said stepping motor and an encoder mounted to one gear of said gear train; and a gap calculation means for calculating an actual gap based on an output from said counter in moving from an adjusted position to a predetermined home position and a predetermined distance between said print head at the home position and said platen.

12. The printer as claimed in claim 10, wherein said paper thickness detecting means comprises:

a stepping motor;

a swing gear fixedly mounted to said guide bar;

a gear train between said stepping motor and said swing gear;

a counter selected from a group consisting of a motor step counter of said stepping motor and an encoder mounted to one gear of said gear train; and a thickness calculation means for calculating a printing sheet thickness based on an output from said counter when advancement of said print head has been stopped against the printing sheet and a predetermined distance between said print head at a predetermined home position and said platen.

13. The printer as claimed in claim 8, wherein the gap range is one of a predetermined gap range correlated to the thickness of the printing sheet and a range that is calculated based upon predetermined factors and the thickness of the printing sheet.

14. The printer as claimed in claim 8, further comprising prohibiting means for prohibiting a printing operation when said signal generating means signals the gap size is outside the gap range.

15. The printer as claimed in claim 8, further comprising:

a cover pivotally mounted to said printer body;

a switch panel mounted on said printer body, said switch panel having a power switch, a select switch and a paper feed switch, wherein said print head gap adjusting apparatus is caused to operate in response to one of turning on said power switch, closing said cover of said printer body and selecting an on-line mode using said select switch, and issuing a paper feed command using said paper feed switch.

* * * * *

UNITED STATES PATENT AND TRADEMARK OFFICE

CERTIFICATE OF CORRECTION

PATENT NO. : 5,156,464

DATED : October 20, 1992

INVENTOR(S) : Kiyoharu SAKAI

It is certified that error appears in the above-identified patent and that said Letters Patent is hereby corrected as shown below:

Column 5, line 65, change "4,990,204" to --4,990,004 --.
line 67, change "S2" to --S1 --.

Signed and Sealed this

Twenty-eighth Day of December, 1993

Bruce Lehman

*Attest:*

BRUCE LEHMAN

*Attesting Officer*

*Commissioner of Patents and Trademarks*